US005222545A

United States Patent [19]

Miksch et al.

[11] Patent Number: 5,222,545

[45] Date of Patent: Jun. 29, 1993

[54] METHOD AND APPARATUS FOR CASTING A PLURALITY OF CLOSELY-SPACED INGOTS IN A STATIC MAGNETIC FIELD

[75] Inventors: Edmond S. Miksch, Murrysville; Que-Tsang Fang, Export, both of Pa.

[73] Assignee: Aluminum Company of America, Pittsburgh, Pa.

[21] Appl. No.: 871,337

[22] Filed: Apr. 21, 1992

[51] Int. Cl.[5] ..... B22D 27/02

[52] U.S. Cl. ..... 164/466; 164/502

[58] Field of Search ..... 164/466, 502, 504, 468

[56] References Cited

U.S. PATENT DOCUMENTS

| | | | |
|---|---|---|---|
| 1,978,222 | 10/1934 | Otte | 175/21 |
| 3,702,155 | 11/1972 | Getselev . | |
| 3,810,504 | 5/1974 | Piwonka . | |
| 3,842,895 | 10/1974 | Mehrabian et al. | 164/466 |
| 4,126,175 | 11/1978 | Getselev . | |
| 4,446,909 | 5/1984 | Yarwood . | |
| 4,450,890 | 5/1984 | Yarwood . | |
| 4,452,297 | 6/1984 | Ungarean . | |
| 4,495,981 | 1/1985 | Kindlmann . | |

FOREIGN PATENT DOCUMENTS

| | | | |
|---|---|---|---|
| 61-199557 | 9/1986 | Japan | 164/466 |

*Primary Examiner*—Kuang Y. Lin

*Attorney, Agent, or Firm*—David W. Pearce-Smith; Craig G. Cochenour

[57] ABSTRACT

Method and apparatus for reducing macrosegregation in the simultaneous casting of a plurality of metal alloy ingots in a continuous or semicontinuous casting operation. Several casting molds are arranged closely together in an array. An outer electromagnetic coil is arranged around the outer periphery of the array of molds and their formed ingots. Preferably, when the circular molds are employed, a solenoid is provided in the central space of the molds. Direct current in the outer coil and in the solenoid create a static magnetic field whose combined effect acts on the liquid pool of the molten metal. The outer coil has straight sides and curved corners. Passive flux return devices are located along the straight sides of the outer coil. If rectangular molds are used, then only the outer electromagnetic coil is arranged around the casting assembly.

29 Claims, 4 Drawing Sheets

METHOD AND APPARATUS FOR CASTING A PLURALITY OF CLOSELY-SPACED INGOTS IN A STATIC MAGNETIC FIELD

BACKGROUND OF THE INVENTION

1. Field of the Invention

This invention relates to a process and apparatus for reducing macrosegregation in the casting of a plurality of closely-spaced ferrous or non-ferrous metal alloy ingots employing at least one substantially static magnetic field that forms the basis for improved ingots having a fine, equiaxed grain structure and a reduced porosity uniformly throughout each ingot.

2. Brief Description of the Prior Art

It is well known by those skilled in the art of continuously or semicontinuously casting ingots that large ingots of metal alloys, for example some hard aluminum alloys, such as 2124, 7050 and 7075, usually exhibit severe ingot centerline macrosegregation. This means that the central region of the ingot is depleted of major alloying ingredients. This is believed to be due to liquid metal convection in the ingot head which is driven by the incoming liquid metal during the pouring stage, and by the density gradients due to thermal and solutal differences produced during the cooling stage. Such convection may carry dendrite fragments and loose dendritic crystals from the outer portions of the ingot to the center of the ingot. Since those fragments or crystals are depleted in alloying ingredients such as copper, magnesium, and zinc due to their partition ratio, the average composition near the ingot centerline becomes much less than the bulk average. As a result of this macrosegregation, the molten material in the central region of the ingot does not develop the desired mechanical properties which may be necessary for certain heavy section applications. That is, since the alloying ingredients increase strength, this depletion of the alloys results in weakened metal in the center of the ingot.

Economically, it is desirable to cast a plurality of metal alloy ingots simultaneous in one installation. In a typical installation, in which a plurality of ingots are cast simultaneously and continuously withdrawn from the molds, the molds are very close together. Controlling macrosegregation in the simultaneous casting of a plurality of metal alloy ingots to maintain a desired uniform concentration of alloy elements throughout each ingot is of particular importance in the production of high quality metal alloy ingots. Ideally, a separate electromagnetic coil should be placed around each mold or around each ingot. However, in view of the close location of the several molds relative to each other, there is not enough room to provide these separate coils, that is, one for each mold or ingot.

Macrosegregation is a term which is used to describe segregation on a scale which is comparable to the dimensions of the ingot. It is distinct from microsegregation which is on the scale of the spacing between the dendrite branches.

Various processes and apparatus for reducing macrosegregation in the casting of a plurality of metal alloy ingots have been known, and various processes and apparatus have been used for controlling the grain structure of such ingots. However, none teach or suggest the improved results of the process and apparatus of the present invention.

U.S. Pat. No. 1,978,222 discloses a method of producing a metallic material employing a mold. This patent states that a magnetic field is applied separately to a casting mold having molten metal therein. Each mold is placed on a base plate which has apertures through which metallic plugs protrude. The magnetic field is applied separately to each ingot by means of the magnetic plug. This patent does not teach that a coil may be passed around a plurality of casting molds.

U.S. Pat. No. 3,810,504 discloses a method and apparatus for the production of directionally solidified castings employing an annular mold having one or more molding cavities. This patent states that a pair of heat radiating elements are disposed concentrically with the mold, one element being located inside the mold and the other element being located outside the mold. To provide directional solidification, the molds are heated on their sides and a chill is provided at their bottoms. This patent states that the mold assembly includes an outer heat source consisting of a cylinder composed of graphite which is heated by an induction coil that is disposed around the molds.

In spite of these prior art disclosures, there remains a very real and substantial need for a process and apparatus for reducing undesired macrosegregation occurring in the center of an ingot, and particularly in the simultaneous casting of a plurality of metal alloy ingots. Such a process and apparatus is disclosed herein and may be employed to create improved ingots having a refined equiaxed grain structure and a reduced pore size.

SUMMARY OF THE INVENTION

The present invention has met the above-described need. The process and apparatus of the present invention provides an efficient and economical approach to reducing macrosegregation in the casting of a plurality of metal alloy ingots. The present invention provides for a process and a related apparatus for providing a plurality of casting molds wherein each mold has a cavity; introducing a metal molten alloy into at least one of the casting mold cavities; cooling the molten metal alloy in at least one of the casting mold cavities to form (a) a solid zone, (b) a liquid-solid mushy zone overlying the solid zone, (c) a liquid zone overlying the liquid-solid-mushy zone and (d) a melt surface on the liquid zone; employing during the cooling a magnetic field generated by an outer electromagnetic coil that extends around the exterior of a portion of an outer surface of the entire group of the casting molds and their formed ingots, and energizing this outer coil by a substantially static or steady electrical current which creates the magnetic field which follows in a path defined by the outer coil and extends around the casting molds resulting in the dampening of convection flows of the molten metal alloy which normally cause macrosegregation along the centerline of the ingot. This process of the invention and its related apparatus for carrying out this process results in producing improved ingots characterized by a refined equiaxed grain structure and a reduced pore size.

The process of the invention may include mixing a grain refining agent with the molten metal alloy prior to introducing the molten metal alloy into the casting mold cavities.

A further embodiment of the invention includes providing solenoid means located generally centrally among the casting molds and the metal alloy ingots. During the cooling, the solenoid means carries an electrical current which also generates a magnetic field for strengthening the magnetic field within the generally central location of the mold cavities and ingots. The magnetic fields produced by the electrical currents in the outer coil and the central solenoid have generally the same direction in the area where the ingots are being solidified. The electromagnetic coil and the solenoid may be in parallel or in series, and be energized by the same power source.

The process of the invention may be employed in the casting of metal alloy ingots such as, for example, aluminum alloys selected from the group consisting of 2xxx, 3xxx, 5xxx, and 7xxx alloy series.

In another embodiment of this invention, the process and its related apparatus includes providing the outer electromagnetic coil with generally a plurality of substantially straight sides and a plurality of generally curved corners such that each of the curved corners connects one of the substantially straight sides to another of the substantially straight sides. Passive flux return means are provided adjacent to and outside of at least one of the substantially straight sides of the outer electromagnetic coil for providing a return path for flux inside the coil means.

It is therefore an object of the present invention to provide a process and apparatus for reducing macrosegregation in the casting of a plurality of metal alloy ingots either simultaneously or one at a time, and in an arrangement comprising a plurality of closely spaced molds.

It is another object of the present invention to provide a process and apparatus for reducing undesired convection in molten metal alloys when casting a plurality of ingots.

It is another object of the present invention to provide a process and apparatus for reducing the macrosegregation in the casting of a plurality of aluminum alloys selected from the group consisting of 2xxx, 3xxx, 5xxx, and 7xxx alloy series.

It is another object of the present invention to provide a process and apparatus that produces a plurality of ingots cast simultaneously such that each ingot has a refined equiaxed grain structure and a reduced pore size.

It is another object of the present invention to provide a process and apparatus for simultaneously casting a plurality of ingots compatible with existing aluminum casting alloy technology, and which is economical in significantly saving space and cost compared to the instance where a single coil is provided for each mold assembly.

It is another object of this invention to provide an improved cast product that has a refined equiaxed grain structure and a reduced pore size, even though several products are produced simultaneously.

It is another object of the invention to provide in a casting installation having a plurality of molds for simultaneously casting a plurality of ingots, an electromagnetic coil placed around the entire group of molds, which coil provides a steady magnetic field in the liquid metal which is being cast, and optionally providing solenoid means centrally located among the molds for generally strengthening the magnetic field in this central region where the magnetic field otherwise would be weakest.

It is a further object of the invention to provide a process and apparatus for casting a plurality of ingots simultaneously with improved mechanical properties along the central region of each ingot, and which mechanical properties are uniform throughout the respective ingot.

These and other objects of the invention will be more fully understood from the following descriptions of the invention, the drawings and the claims appended hereto.

DESCRIPTION OF THE PREFERRED EMBODIMENTS

The process and apparatus of this invention provide for a reduction of macrosegregation in the casting of a plurality of metal alloy ingots in an arrangement having a plurality of closely spaced molds.

As employed herein, "casting" includes semicontinuous and continuous casting of metal alloys of various shapes and includes bi-level casting, level pour casting, and horizontal systems well known by those skilled in the art. Additionally, as employed herein, "casting mold" includes a direct chill mold such that a solid forms in the cavity of the mold capable of supporting the V-shaped pool of liquid in the center of the casting.

As employed herein, "solenoid means" includes a coil of wire or water-cooled copper tubing having many turns in one or more layers wound around a ferromagnetic flux path.

As used herein, "electromagnetic coil means" includes a single coil or a plurality of coils or water-cooled copper tubing or superconductors cooperating to create generally the same substantially static magnetic field as could be achieved by one coil.

As employed herein, "substantially static or steady magnetic field" means a direct current magnetic field.

As employed herein, "substantially static electrical current" means a direct current. As employed herein, "direct current" means a current in which (a) the flow of charges is all in one direction for the period of time under consideration, and (b) the magnitude is generally constant except with minor pulsations in its amplitude.

Figure 1:
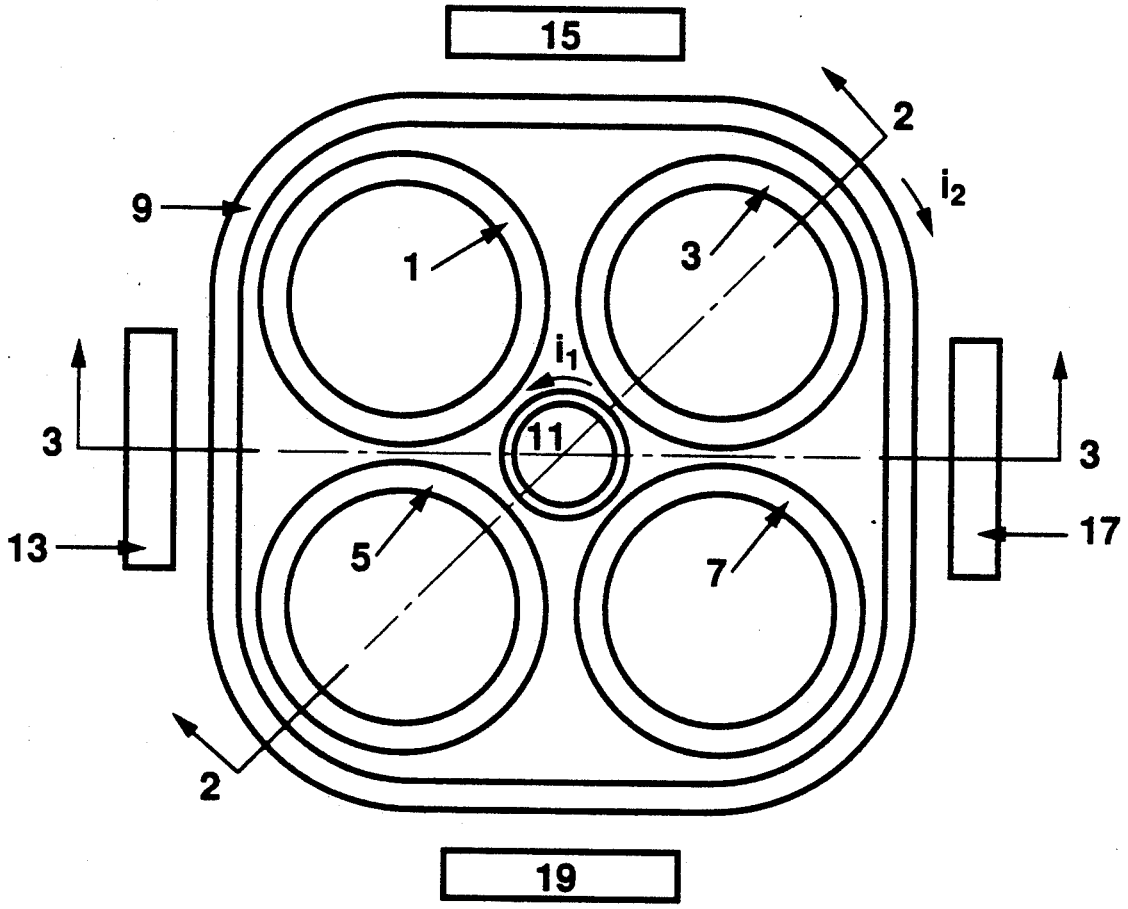
FIG. 1 shows a schematic top plan view of a first embodiment of the invention.

One embodiment of the invention will now be discussed with reference to FIGS. 1-3, where the same numerals represent the same components. FIG. 1 schematically illustrates a casting assembly comprising circular mold assemblies 1, 3, 5, and 7 for receiving molten metal for forming ingots. According to well-known practice, the liquid metal is poured into the head of assemblies 1, 3, 5, and 7 from ladles (not shown) or through feed tubes or troughs (not shown) located above the mold assemblies. The mold assemblies are constructed similarly to those known in the art and include chill means which cool and progressively solidify the cast metal.

In accordance with conventional practice, the molten metal alloy, which may contain a grain refining agent, is introduced into each of the casting molds 1-7. Contact with the walls of the mold cavities causes a thin layer of metal to solidify. The solidified metal and the liquid metal is drawn downward out of the molds to form an ingot. Cooling of the partly solidified ingot below each mold 1-7 is accomplished by water sprayed onto the solidified surfaces.

Referring again to FIGS. 1-3, an electromagnetic coil 9 extends around the outer periphery and encircles mold assemblies 1-7 and their formed ingots. Located generally centrally relative to casting assemblies 1-7, is a solenoid 11. Both electromagnet coil 9 and solenoid 11 carry an electrical circuit which create a first and a second magnetic field, more about which will be discussed hereinafter. Several passive flux return devices 13, 15, 17, and 19 are located outside coil 9 and extend preferably parallel to and along the straight sides of coil 9. Preferably, flux return devices 13-19 are made of a ferrous material, and provide a return path for the magnetic flux inside the straight sides of coil 9.

Figure 2:
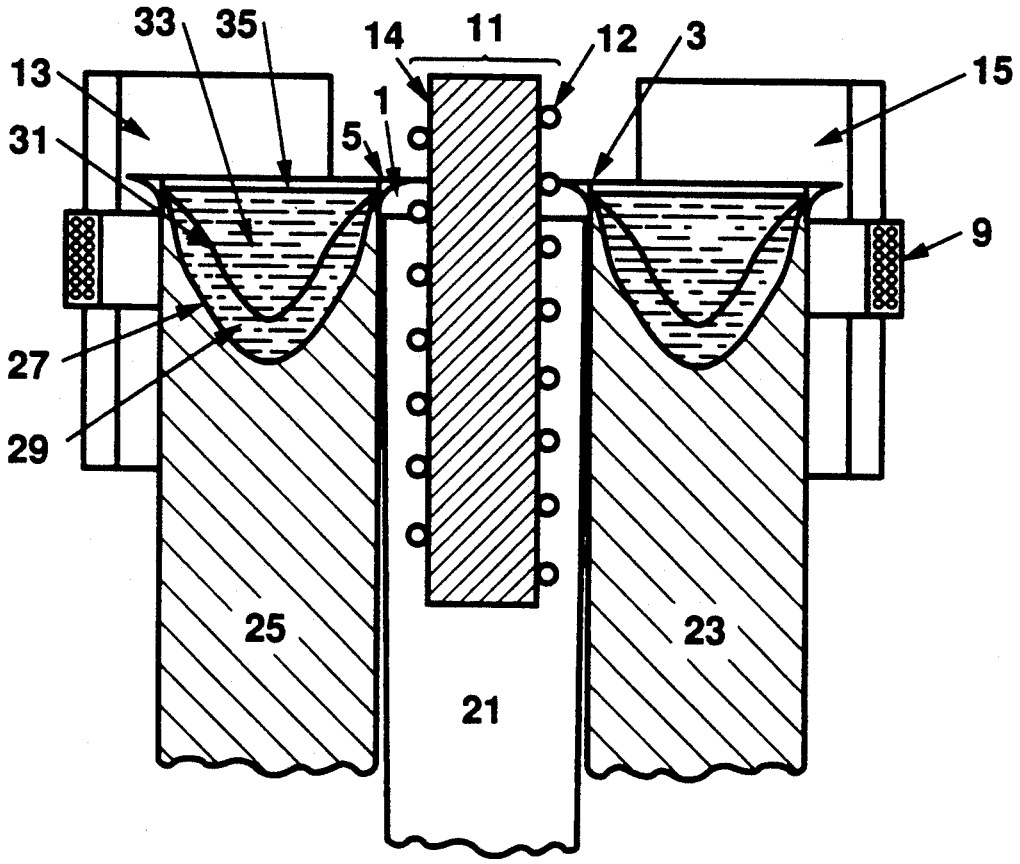
FIG. 2 shows a schematic cross-section taken through lines 2—2 of FIG. 1.

As shown in FIG. 2, electromagnetic coil means 9 extends near the top, open end of casting molds 1, 3, and 5, and around an exterior portion of their respective formed metal alloy ingots indicated at 21, 23, and 25 in FIG. 2.

FIG. 2 schematically shows in cross section the normal solidification process for the molten metal in the forming of ingots 23 and 25 in mold assemblies 3 and 5, respectively. Numeral 27 identifies a darkline representing the interface between solid zone 25 (solidified ingot) and the liquid-solid mushy zone 29. Reference number 31 refers to the interface between liquid-solid mushy zone 29 and the liquid zone (pool) 33. Liquid zone 33 has a melt surface indicated at reference number 35.

FIG. 2 also illustrates the preferred type of solenoid 11 for utilization in the invention. Solenoid 11 comprises a long wire or copper tube 12 arranged around a core 14 to form a plurality of turns in a helix fashion. Core 14 is preferably ferromagnetic in that a ferromagnetic core is more efficient than a non-ferromagnetic core. Core 14 is shown in FIG. 1 as being circular in cross-section. However, core 14 may have a cross-section consisting of a square with rounded corners. This latter shape for core 14 may preferably be used in order to obtain the largest possible cross-section for magnetic flux in the central space between mold assemblies 1-7. As shown by flux devices 13 and 15 in FIG. 2, flux devices 13, 15, 17, and 19 extend above and down along a portion of mold assemblies 1, 3, 5 and 7.

Figure 3:
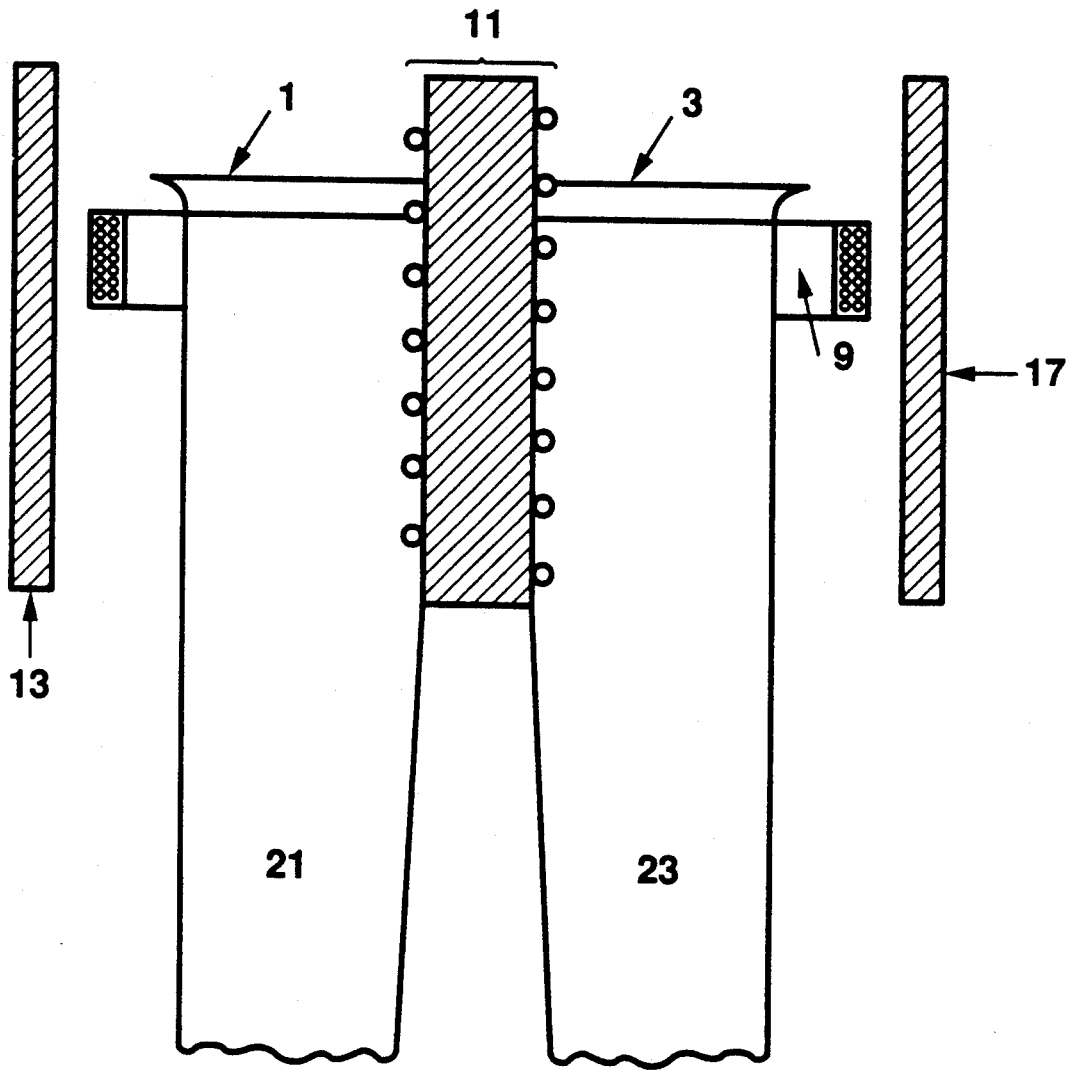
FIG. 3 shows a schematic cross-section taken through lines 3—3 of FIG. 1.

As shown by flux devices 13 and 17 in FIG. 3, flux devices 13, 15, 17 and 19 are spaced outside of electromagnetic coil 9. Passive flux devices 13-19 lay outside the perimeter of coil 9 which, in turn, encircles the casting assembly comprising mold assemblies 1-7. It is not necessary for devices 13-19 to have windings and currents, since their purpose is to generally serve as flux return paths for the magnetic field produced by coil 9. These devices 13-19 are preferably located along the straight sides of coil 9 (FIG. 1) and not near the corners of coil 9. The reason being that the magnetic field inside the perimeter of coil 9 is strongest near the corners of coil 9. That is, since the magnetic field adjacent to the straight sides of coil 9 is weaker than the magnetic field near its corners, the flux return paths of flux devices 13-19 in their location shown in FIG. 1 strengthen the magnetic field near the straight sides of coil 9.

Flux devices 13-19 increase the magnetic field generated in coil 9, but do little to increase the strength of the magnetic field of solenoid 11 effecting the ingots in mold assemblies 1-7. The strength of the magnetic field of solenoid 11 is determined and controlled by its shape, size, the permeability of its core, and the number of ampere-turns carried by its winding. As stated hereinbefore, preferably, passive flux devices 13-19 are made of iron because of its magnetic properties.

Both electromagnetic coil 9 and solenoid 11 carry an electrical current, which preferably is a direct current which produces a steady magnetic field in the coil 9 and solenoid 11, and thus, in the liquid metal of the heads of the ingots within mold assemblies 1-7.

Separate power sources may be provided to supply DC current to coil 9 and solenoid 11 where separate currents may be created, or the same power source may be used for both coil 9 and solenoid 11 where their currents may be connected in series or in parallel. If the coil 9 and solenoid 11 are connected in series, they, preferably, carry the same amperage. If they are connected in parallel, they should be designed for the same voltage. The solenoid may produce a magnetic field from about 200 to 1,000 gauss.

The liquid metal in the heads of the ingots of mold assemblies 1-7 experience the combined effect of the two magnetic fields generated by coil 9 and solenoid 11, and does not distinguish between the first magnetic field of coil 9 and the second magnetic field of solenoid 11. The combined effect of the static magnetic fields of coil 9 and solenoid 11 dampens the convection flows of the liquid pool of each ingot being cast, which normally causes macrosegregation, thereby reducing macrosegregation, reducing hydrogen pore size, and producing finer grain sizes for some alloys.

Electromagnetic coil 9 may be made of copper or aluminum tubing, or may be a superconductor, and preferably, as shown particularly in FIG. 1, encircles the entire group of mold assemblies 1-7.

Figure 4:
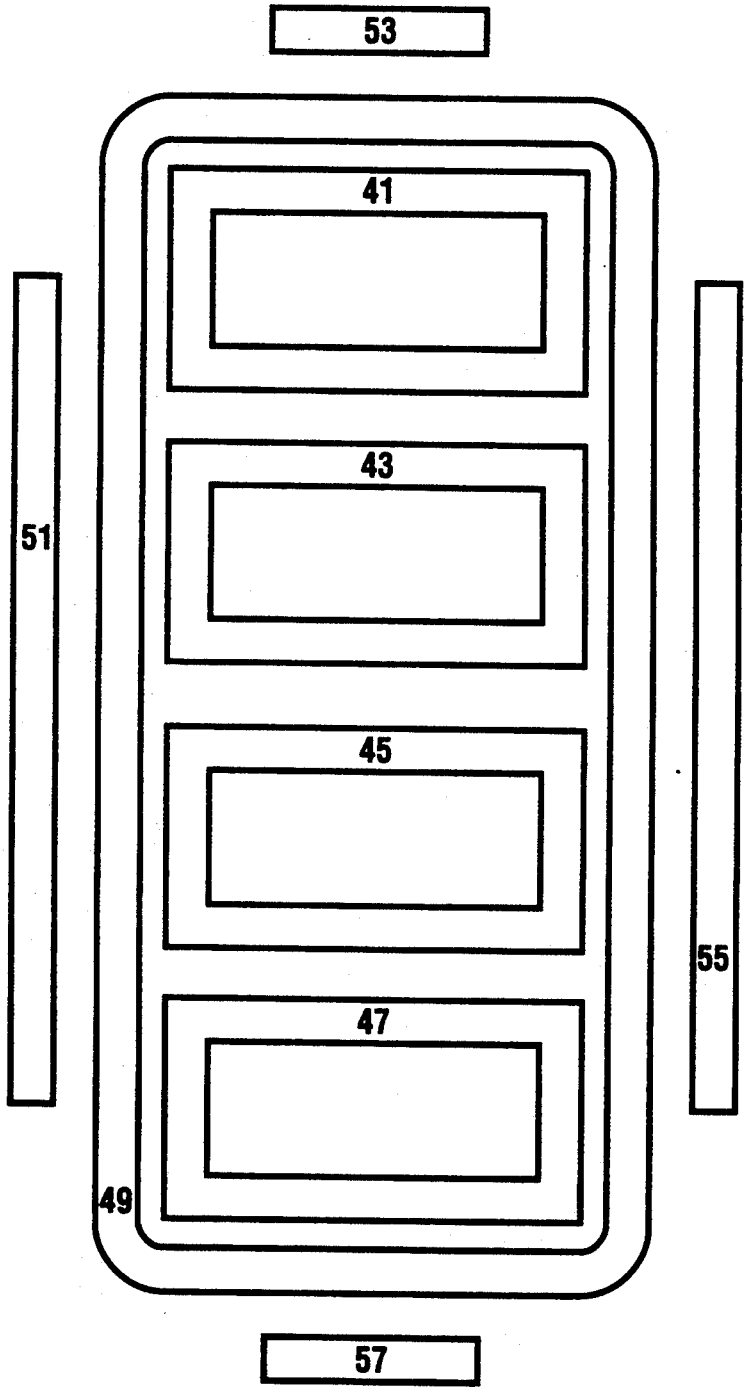
FIG. 4 shows a schematic top plan view of a second embodiment of the invention.

FIG. 4 illustrates a second embodiment of the direct current magnetic dampening apparatus of the present invention. In FIG. 4, casting mold assemblies 41, 43, 45 and 47 are shown having a rectangular shape. Reference numeral 49 identifies an outer electromagnetic coil means which encircles the entire group of mold assemblies 41-47, and which extends around the exterior of a top portion of the outer surface of casting mold assemblies 41, 43, 45 and 47. Preferably, a direct current is supplied to outer coil 49 in either a clockwise or a counterclockwise direction when referring to FIG. 4. Passive iron flux return devices 51, 53, 55, and 57 are located adjacent to the straight sides of outer coil 49. Coil 49 has four substantially straight sides connected by four generally curved corners similar to coil 9 of FIG. 1.

As can be seen in FIG. 4, flux return devices 51 and 55 have a longer length than that of devices 53 and 57. Based on what was discussed with regard to the flux return devices 13-19 of FIG. 1, it is important to appreciate that the flux devices of both FIGS. 1 and 4 extend a length substantially equal to that of the straight sides of electromagnetic coil 9 and 49, respectively. Needless to say, flux devices 51 and 55 can extend a greater length than that of devices 53 and 57 to substantially extend the length of the straight sides of coil 49 extending parallel to devices 51 and 55.

Still referring to FIG. 4, mold assemblies 41-47 are water cooled casting molds known in the art, and as can be seen, each mold assembly 41-47 has a rectangular mold cavity which is typically about 50 inches long and 16 inches wide in cross-section. The height of each mold assembly 41-47 is approximately 6 inches.

In contrast to this, the mold assemblies 1-7 of FIG. 1 are circular and each have a mold cavity which is also circular in cross-section with a diameter of approximately 20 to 40 inches. The height of each mold assembly 1–7 is approximately 6 inches. It is preferred that coils 9 and 49 of FIGS. 1 and 4 be in the configuration shown therein with the straight sides connected by curved corners. However, in some applications it may be more efficient or desirable to provide a circular or elliptical configuration for coils 9 and 49. It is to be noted that if circular ingots are being formed in the circular mold assemblies 1–7 of FIG. 1 that the extent of radius of the corners of electromagnetic coil 9 of FIG. 1 is greater than the curved corners of electromagnetic coil 49 of FIG. 4. It is preferred that each of the mold cavities of mold assemblies 1–7 and 41–47 of FIGS. 1 and 4, respectively, be of the same general cross-section, that is all being circular with regard to FIG. 1 and all being rectangular with regard to FIG. 4.

Preferably, coils 9 and 49 of FIGS. 1 and 4, respectively, are spaced approximately two to six centimeters away from the outer surface of the upper portions of their respective mold assemblies, (FIGS. 1 and 4) and down from the top of their respective mold assemblies and pass around and along the exterior of each of their respective ingots (FIG. 2).

The flux return devices 13–17 and 51–57 of FIGS. 1 and 4, preferably are made of a ferromagnetic material such as iron, which includes low carbon steels, magnetic stainless steel, or in some applications cobalt or nickel. The flux devices 13–17 and 51–57 are located immediately adjacent to coil 9 and 49, respectively, or approximately 1 to 12 inches away from coils 9 and 49.

Referring again to FIG. 1, the arrows indicate the direction for the current for coil 9 and the current for solenoid $i_1$. The current $i_2$ for coil 9 is shown to be traveling in a clockwise direction, whereas, the current $i_1$ for solenoid 11 is traveling in a counterclockwise direction. It is not necessary for the currents $i_1$ and $i_2$ to be traveling in the directions shown, but what is to be appreciated is that the direction for the current of solenoid 11 preferably is opposite to that of coil 9. The magnetic field generated by the current of coil 9 is referred to as a first field and as having a certain direction. The current in solenoid 11 generates a magnetic field which is to be referred to as a second magnetic field. This second magnetic field in the center of solenoid 11 is in the opposite direction to that of the first magnetic field of coil 9. The return field of solenoid 11 is the field of interest, since it occupies the space where mold assemblies 1–7 are located, and it is to be appreciated that this return field of solenoid 11 has generally the same direction as the first magnetic field of coil 9.

The invention of FIGS. 1–4 is used to cast a plurality of ingots made from molten metal alloy. The metal alloy may be an aluminum alloy selected from the group consisting of 2xxx, 3xxx, 5xxx, and 7xxx alloy series. For example, the invention may include employing alloy 2124, alloy 3004, alloy 7050, or alloy 7075. It will be appreciated by those skilled in the art that the aluminum alloys of the present invention may include impurity levels which are commercially acceptable in such alloys.

The operation of the present invention employing the casting assembly of FIG. 1 will now be discussed. The casting process is done according to the principles and operation of the prior art. The invention has particular application if several ingots are cast simultaneously in mold assemblies 1–7, but still applies if only one ingot is cast. As the molten metal is being poured simultaneously into mold assemblies 1–7, direct current is supplied to coil 9 and to solenoid 11. During this process, the molten metal alloy in the mold cavities of assemblies 1–7 cools and solidifies, to eventually form the several zones 29, 33, and 35 for the molten metal in the top of the ingot as shown in FIG. 2. During the pouring process, and through the employment of the magnetic field generated in coil 9 with its combined effect of the magnetic field of solenoid 11 on the ingot as it is being cast, and as discussed hereinbefore, the convection flows of the hot molten metal alloy are dampened or decreased, resulting in at least reduced macrosegregation, particularly in the top or head portion along the centerline of each ingot formed in mold assemblies 1–7.

Technically, and what is known in the art, is that in general a magnetic field interacts with the molten metal, to produce eddy currents in the ingot. In the invention of FIG. 1 the magnetic fields of coil 9 and solenoid 11 produce eddy currents, which, in turn, produce forces which oppose the fluid currents in the liquid metal.

In effect, the dendrite fragments and loose dendritic crystals which are depleted of alloying ingredients from the outer regions of the formed ingots are substantially prevented from being forced into the center of the ingots.

The operation and effect in the ingots formed by the casting assembly of FIG. 4 is similar to that discussed above with regard to FIG. 1. Even though a solenoid is not provided in the casting arrangement of FIG. 4, it is to be appreciated that the coil 49 produces a magnetic field with sufficient intensity to obtain the desired mechanical and magnetic properties in the formed ingots, particularly in the central region of the head of each ingot.

Even though the vertical cross-section of coil 9 as shown in FIG. 2 is generally rectangular, it is appreciated that it may also be square or circular. The cross-sectional configuration for coil 9 is independent from the symmetry of the ingots being produced. This also applies to the casting arrangement of FIG. 4.

In the casting of ingots in the embodiments of FIGS. 1 and 4, it is also to be appreciated that the casting process may include mixing a grain refining agent with the molten metal alloy prior to introducing the molten metal alloy into the mold cavities.

Even though the casting assemblies of FIGS. 1 and 4 contain mold shapes which form a solid ingot, the present invention works just as well on casting mold cavities with cores, which as is well known in the art, form a hollow portion or portions in the ingot.

FIGS. 1 and 4 have been discussed hereinbefore as having the electromagnetic coil 9 and 49, respectively, as being located in the top portion of the mold assemblies 1–7 and 41–47, respectively. The coil 9 and 49 may also be located generally above the top end of the mold assemblies, or along the length of the casting mold assemblies other than shown in FIG. 2. It is important, however, that coil 9 and 49 substantially encircle their respective array of mold assemblies. Also, coils 9 and 49 may actually be in physical contact with the outer surface of their respective mold assemblies. Only one coil 9 or coil 49 is disclosed as encircling their respective casting assembly. It is to be understood that more than one such coil can be used arranged either adjacent to each other or spaced apart along the outer periphery of the mold assemblies, and substantially encircling the mold assemblies.

The invention may be used in the conventional continuous or semicontinuous casting mold arrangements, well known to those in the skilled art. Employing the teachings of the present invention results in each of the ingots formed by mold assemblies 1–7 and 41–47 as having refined, equiaxed grain structures. This is in contrast to earlier teachings involving magnetic fields which produce a transition to coarse columnar grains. The pore size of the formed ingots of the invention are smaller compared to the pore size of ingots produced by the prior art, especially prior arrangements which do not teach the employment of a magnetic field. The magnetic field effect created by the invention reduces or eliminates large gas pores, which normally occur in the ingot due to the amount of hydrogen in the melt.

Whereas particular embodiments of the invention have been described herein for purposes of illustration, it will be evident to those skilled in the art that numerous variations in the details of the present invention may be made without departing from the invention as defined in the appended claims.

For instance, even though the outer coil 9 is shown to be disposed substantially adjacent to the mold assemblies 1–7 and their formed ingots, coil 9 may be disposed generally above or below the mold assemblies 1–7 of FIG. 2 and the mold assemblies 41–47 of FIG. 4.

What is claimed:

1. An arrangement used in casting a plurality of metal alloy ingots, comprising:

an array of casting mold assemblies, each having an outer surface, a cavity for receiving molten metal alloy for forming an ingot, and cooling means for cooling said molten metal alloy to effect solidification thereof, outer electromagnetic means encircling at least said array of casting mold assemblies, and for delivering a substantially static electrical current to generate a substantially static magnetic field around said array of mold assemblies and their respective ingot to obtain a desired microstructure of said ingot for said each mold assembly.

2. An arrangement of claim 1, further comprising:

inner electromagnetic means disposed generally centrally among said array of casting molds, and for delivering a substantially static electrical current to generate a substantially static magnetic field having components which travel in a direction near said array of mold assemblies and their respective ingot and which combine with said magnetic field of said outer electromagnetic means to obtain said desired microstructure of said ingot for said each mold assembly.

3. An arrangement of claim 2, wherein said outer electromagnetic means is a coil, and wherein said inner electromagnetic means is a solenoid.

4. An arrangement of claim 2, further comprising power supply means for connecting said outer and inner electromagnetic means in series.

5. An arrangement of claim 2, further comprising power supply means for electrically connecting said outer and inner electromagnetic means in parallel.

6. An arrangement of claim 2, wherein said inner electromagnetic means includes means for directing said electrical current in a direction opposite to the direction of said electrical current of said outer electromagnetic means.

7. An arrangement of claim 1, wherein said outer electromagnetic means has generally a plurality of substantially straight sides and a plurality of generally curved corners such that each of said curved corners connects one of said substantially straight sides to another of said substantially straight sides.

8. An arrangement of claim 7, further comprising:

passive flux return means disposed adjacent to at least one of said substantially straight sides of said outer electromagnetic means for increasing the strength of said magnetic field of said outer electromagnetic means.

9. An arrangement of claim 8, wherein said flux return means is made of a ferromagnetic material selected from the group consisting of iron, magnetic stainless steel, nickel, and cobalt.

10. The apparatus of claim 1, wherein said outer electromagnetic means is disposed generally above said casting mold assemblies.

11. An arrangement of claim 1, wherein said outer electromagnetic means is disposed generally below said casting mold assemblies, and passes around the exterior of each of said ingots.

12. An arrangement of claim 1, wherein said outer electromagnetic means is disposed generally around the exterior of said outer surface of each said casting mold assemblies.

13. An arrangement of claim 1, wherein said outer electromagnetic means is disposed along the length and near the top of said casting mold assemblies to effect a desired microstructure in the central top region of said each formed ingot in said mold assemblies.

14. An arrangement of claim 1, wherein said mold assemblies are disposed in a generally rectangular configuration and wherein said outer electromagnetic means is arranged around said array of mold assemblies in generally a rectangular configuration.

15. An arrangement of claim 1, wherein said mold assemblies are disposed in a generally linear configuration, and wherein said outer electromagnetic means is arranged around said array of mold assemblies in generally a rectangular configuration.

16. An arrangement of claim 1, wherein said mold assemblies each have a generally circular cavity, and wherein said outer electromagnetic means is arranged around said array of mold assemblies in generally a non-circular configuration.

17. An arrangement of claim 1, wherein said outer electromagnetic means includes at least one coil having water-cooled copper tubing.

18. An arrangement of claim 1, wherein said outer electromagnetic means includes at least one coil with an outer diameter of about 0.50 to 1.50 centimeters, and wherein said electrical current is approximately 500 to 1500 amperes.

19. An arrangement of claim 11, wherein said outer electromagnetic means is spaced away from said each of said casting mold assemblies about two to six centimeters.

20. A process for reducing macrosegregation in the casting of a plurality of metal alloy ingots, comprising:

providing an array of casting molds, each having a cavity for receiving molten metal alloy;

simultaneously introducing said molten metal alloy into said each mold cavity, cooling said molten metal alloy to form a solid zone, a liquid-solid mushy zone overlying said solid zone, a liquid zone overlying said liquid-solid mushy zone, and a melt surface on said liquid zone; and providing outer electromagnetic means around said array of casting molds, and during said cooling energizing said outer electromagnetic means by a substantially static electrical current to generate a substantially static magnetic field to decrease the convection flows of said molten metal in said zones and thereby retain said alloys in said molten metal in said zones.

21. A process of claim 20, the steps further comprising:

mixing a grain refining agent with said molten metal alloy prior to introducing said molten metal alloy into said cavity of said each mold assembly.

22. A process of claim 20, the steps further comprising:

employing inner electromagnetic means, generally centrally among said casting molds, and during said cooling, energizing said inner electromagnetic means by a substantially static electrical current to generate a substantially static magnetic field having components which travel in a direction near said array of casting molds and combine with said magnetic field of said electromagnetic means for said reducing of said macrosegregation in each ingot produced in said array of casting molds.

23. A process of claim 22, the steps further comprising employing solenoid means with a ferromagnetic core as said inner electromagnetic means.

24. A process of claim 22, the steps further comprising:

causing said electrical current of said inner electromagnetic means to travel in a direction opposite to the direction of travel of said electrical current of said outer electromagnetic means.

25. A process of claim 20, the steps further comprising employing coil means as said outer electromagnetic means.

26. A process of claim 20, the steps further comprising;

providing said outer electromagnetic means with a plurality of straight sides and curved corners for connecting said straight sides, and increasing the strength of said magnetic field of said outer electromagnetic means along said straight sides thereof by providing passive flux return device outside of said outer electromagnetic means.

27. A process of claim 20, the steps further comprising:

selecting an aluminum alloy selected from the group consisting of 2xxx, 3xxx, 5xxx, and 7xxx alloy series.

28. A process of claim 20, the steps further comprising:

producing ingots having a refined equiaxed grain structure.

29. A process of claim 20, the steps further comprising:

producing said ingots having a reduced pore size.

* * * * *